US010175603B2

(12) United States Patent
Matsumoto

(10) Patent No.: US 10,175,603 B2
(45) Date of Patent: Jan. 8, 2019

(54) IMAGE FORMING APPARATUS WITHOUT COLOR POINTS APPEARED IN AN IMAGE

(71) Applicant: FUJI XEROX CO., LTD., Tokyo (JP)

(72) Inventor: Yasutaka Matsumoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/725,287

(22) Filed: Oct. 5, 2017

(65) Prior Publication Data

US 2018/0101109 A1 Apr. 12, 2018

(30) Foreign Application Priority Data

Oct. 6, 2016 (JP) ..... 2016-198068

(51) Int. Cl.
*G03G 15/02* (2006.01)
*G03G 9/16* (2006.01)
*G03G 21/16* (2006.01)

(52) U.S. Cl.
CPC ..... *G03G 15/0266* (2013.01); *G03G 9/16* (2013.01); *G03G 21/169* (2013.01)

(58) Field of Classification Search
CPC ..... G03G 15/0266; G03G 9/16; G03G 21/169
USPC ..... 399/50
See application file for complete search history.

(56) References Cited

U.S. PATENT DOCUMENTS 6,070,047 A * 5/2000 Ichinose ..... G03G 15/161 399/174
2010/0330481 A1* 12/2010 Yagi ..... G03G 5/082 430/66
2015/0277245 A1* 10/2015 Kajiwara ..... G03G 5/047 430/58.2

FOREIGN PATENT DOCUMENTS

JP 2011-065066 3/2011
JP 2011138001 A * 7/2011

* cited by examiner

*Primary Examiner* — Susan S Lee
(74) *Attorney, Agent, or Firm* — JCIPRNET

(57) ABSTRACT

An image forming apparatus includes a rotatable image carrier that carries an image; a charging unit that includes a rotatable charging member that charges the image carrier; a developing unit that supplies developer to the image carrier that is charged, the developer containing at least toner and a carrier, an external additive being added to the toner; a transfer unit that includes a transfer member that transfers the image formed on the image carrier to a transfer material; and a cleaning unit that cleans a surface of the image carrier. In the image forming apparatus, during image non-formation, the external additive is supplied to the image carrier that rotates, and the image carrier and at least the transfer member are separated from each other.

6 Claims, 6 Drawing Sheets

FIG. 6A

| | POTENTIAL DIFFERENCE (V) | CHARGING ROLLER AC COMPONENT | IMAGE WHITE PATCHES |
|---|---|---|---|
| COMPARATIVE EXAMPLE | −90 | OUTPUT | POOR |
| COMPARATIVE EXAMPLE | −150 | OUTPUT | FAIR |
| EXEMPLARY EMBODIMENT | −200 | OUTPUT | GOOD |
| EXEMPLARY EMBODIMENT | −200 | STOP | EXCELLENT |

FIG. 6B

| | TRANSFER ROLLER | PHOTOCONDUCTOR DENTS |
|---|---|---|
| COMPARATIVE EXAMPLE | CONTACT | POOR |
| EXEMPLARY EMBODIMENT | SEPARATE | GOOD |

IMAGE FORMING APPARATUS WITHOUT COLOR POINTS APPEARED IN AN IMAGE

CROSS-REFERENCE TO RELATED APPLICATIONS

This application is based on and claims priority under 35 USC 119 from Japanese Patent Application No. 2016-198068 filed Oct. 6, 2016.

BACKGROUND

Technical Field

The present invention relates to an image forming apparatus.

SUMMARY

According to an aspect of the invention, there is provided an image forming apparatus including a rotatable image carrier that carries an image; a charging unit that includes a rotatable charging member that charges the image carrier; a developing unit that supplies developer to the image carrier that is charged, the developer containing at least toner and a carrier, an external additive being added to the toner; a transfer unit that includes a transfer member that transfers the image formed on the image carrier to a transfer material; and a cleaning unit that cleans a surface of the image carrier. In the image forming apparatus, during image non-formation, the external additive is supplied to the image carrier that rotates, and the image carrier and at least the transfer member are separated from each other.

BRIEF DESCRIPTION OF THE DRAWINGS

An exemplary embodiment of the present invention will be described in detail based on the following figures, wherein:

FIG. 6A illustrates the relationship between potential difference and image defects, and FIG. 6B illustrates the relationship between the existence/nonexistence of separation between the photoconductor and the first transfer roller and photoconductor defects.

DETAILED DESCRIPTION

An exemplary embodiment of the present invention is hereunder described with reference to the drawings. However, the exemplary embodiment that is described below is only illustrative of an image forming apparatus for embodying the technical ideas of the present invention, and is not intended to limit the present invention; and is equally applicable to other exemplary embodiments that fall within the scope of the claims.

Exemplary Embodiment

Figure 1:
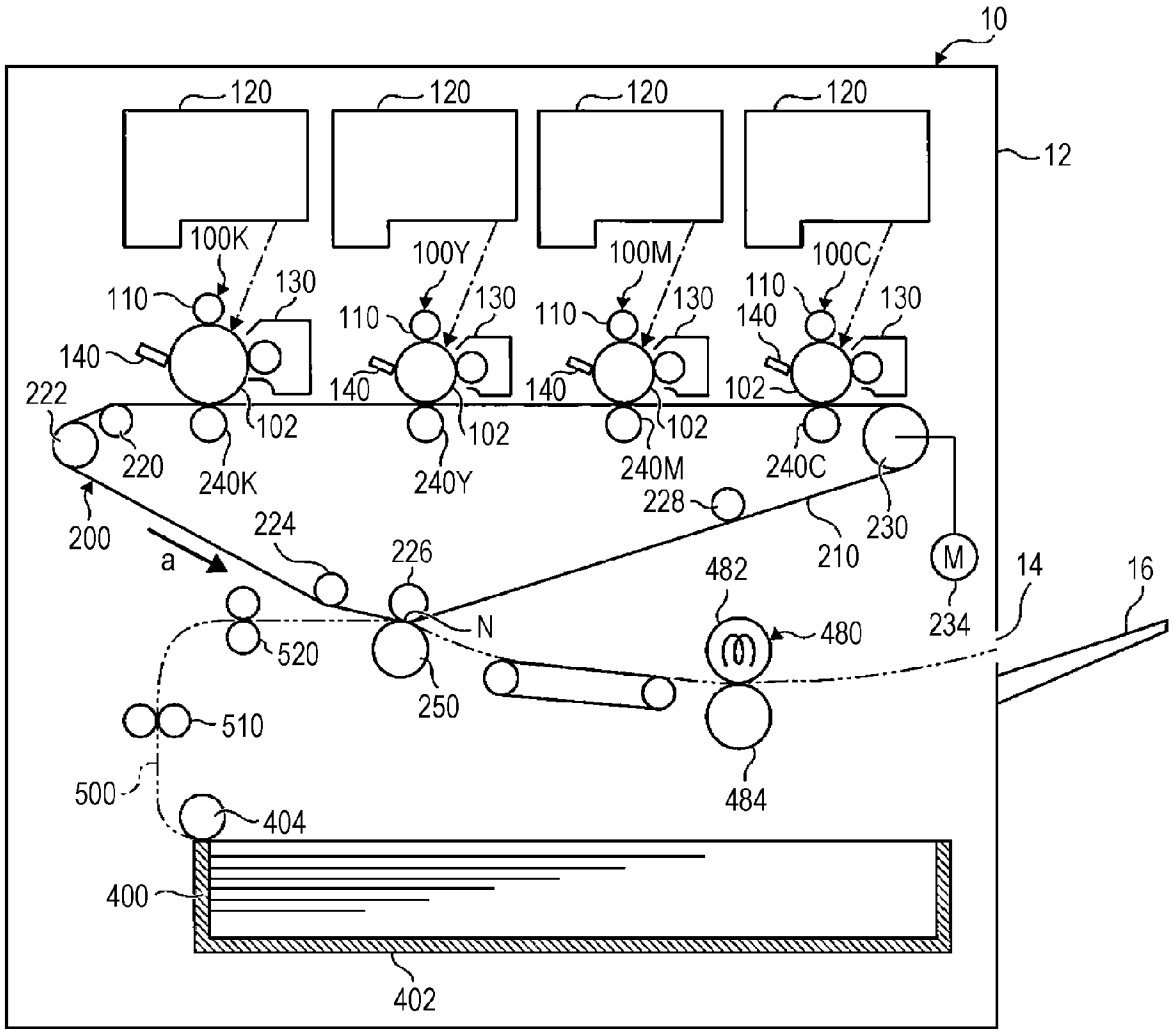
FIG. 1 illustrates an image forming apparatus according to an exemplary embodiment of the present invention.

First, an image forming apparatus 10 according to an exemplary embodiment is described with reference to FIGS. 1 and 2A and 2B. As illustrated in FIG. 1, the image forming apparatus 10 according to the exemplary embodiment includes an image forming apparatus body 12. An image forming unit 100K that forms a black toner image, an image forming unit 100Y that forms a yellow toner image, an image forming unit 100M that forms a magenta toner image, an image forming unit 100C that forms a cyan toner image, a transfer device 200, a fixing device 480, and a sheet-feeding device 400 are disposed in the image forming apparatus body 12. A transport path 500 for transporting sheets used as recording media is formed in the image forming apparatus body 12.

The image forming apparatus body 12 has a discharge opening 14 for discharging sheets. A discharge tray 16 used as a discharge unit for discharging a sheet thereon after forming an image on the sheet is mounted on the image forming apparatus body 12.

The image forming units 100K, 100Y, 100M, and 100C have the same structure, and are hereunder collectively referred to as image forming unit 100. As illustrated in FIGS. 1 and 2A, the image forming unit 100 employs an electrophotographic system; and includes a photoconductor 102 that has, for example, a cylindrical shape and that is used as an image carrier that carries an image formed by using toner, a charging device 110 that serves as a charging unit that charges the photoconductor 102, a latent image forming device 120 that applies light to the surface of the photoconductor 102 charged by the charging device 110 to form an electrostatic latent image on the surface of the photoconductor 102, a developing device 130 that serves as a developing unit that develops the latent image formed on the photoconductor 102 by using a developer 600 containing toner to form a toner image on the surface of the photoconductor 102, and a cleaning device 140 that serves as a cleaning unit that cleans the photoconductor 102 after the toner image has been transferred to an intermediate transfer body 210 described later by the transfer device 200.

Figure 2A:
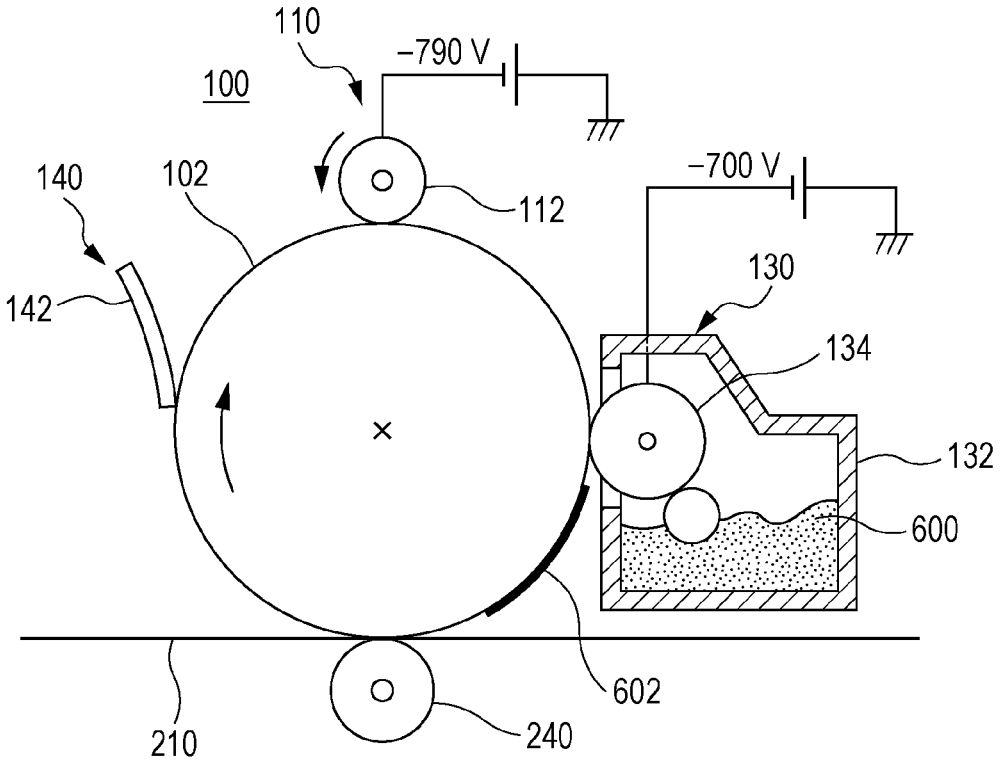
FIG. 2A illustrates an image forming unit of the image forming apparatus.
Figure 2B:
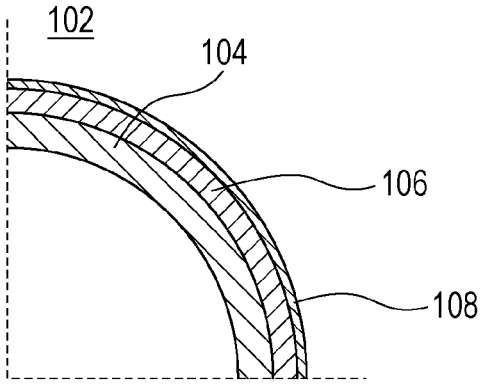
FIG. 2B is a partial sectional view of a photoconductor.

As illustrated in FIG. 2B, the photoconductor 102 is a cylindrical body including multiple layers, and includes at least a base 104, a photosensitive layer 106, and a protective layer 108. The base 104 is made of, for example, an aluminum alloy. The photosensitive layer 106 is disposed around an outer periphery of the base 104 and is made of, for example, amorphous silicon. The protective layer 108 covers the photosensitive layer 106. The protective layer 108 of the photoconductor 102 according to the exemplary embodiment is a layer that contains at least gallium (Ga) and oxygen (O) as constituent elements.

It is desirable that the thickness of the protective layer 108 be 0.2 μm to 1.5 μm, and the micro-hardness thereof be 2 GPa to 15 GPa. By forming the protective layer 108 as a layer containing at least gallium (Ga) and oxygen (O) as constituent elements, the surface of the photoconductor 102 is provided with water repellency, so that it is possible to reduce the adhesivity of discharge products 700 and thus to make it easier to remove the discharge products 700 (described later).

The charging device 110 includes, for example, a charging roller 112 that is used as a charging member that contacts and charges the photoconductor 102. A charging voltage is applied to the charging roller 112 at a predetermined timing to charge the photoconductor 102. In the image forming apparatus 10 according to the exemplary embodiment, during image formation, in order to charge the photoconductor 102, the charging device 110 applies a negative (−) voltage, such as a charging voltage of −790 V, to the photoconductor 102 via the charging roller 112. The charging voltage is applied by superimposing an alternating-current (AC) component and a direct-current (DC) component.

As illustrated in FIG. 2A, the developing device 130 includes a developing device body 132. A developer transporting member 134 in the form of, for example, a roller is mounted on the developing device body 132. The developing device body 132 contains the developer 600. The developer 600 is a mixture of toner (toner image) 602 and carriers 620 (see FIG. 3B). For example, zinc stearate (ZnSt), used as a metal soap, is added to the toner 602 as external additives 610. The developer transporting member 134 applies a predetermined developing voltage to the toner 602 in the developer 600, and transports the toner 602 towards the photoconductor 102, so that the toner image is formed on the surface of the photoconductor 102 by the development.

In the developing device 130 according to the exemplary embodiment, a negative (−) voltage, such as a voltage of −700 V, is applied as a developing voltage to the toner 602 at the developer transporting member 134. Here, the external additives 610 are charged to a polarity that is opposite to that of the toner 602, that is, to a positive (+) polarity.

As described later, the image forming apparatus 10 according to the exemplary embodiment has a structure in which the discharge products 700 adhered to the photoconductor 102 are removed by using the external additives 610. Zinc stearate (ZnSt), used as the external additives 610 according to the exemplary embodiment, has the property of strongly combining with and adhering to the discharge products 700. The discharge products 700 strongly adhere to the external additives 610 from the surface of the photoconductor 102. Therefore, by removing the external additives 610 to which the discharge products 700 have adhered, it is possible to easily remove the discharge products 700 on the surface of the photoconductor 102.

The cleaning device 140 includes a cleaning member 142 that is in the form of, for example, a plate and that contacts and cleans the surface of the photoconductor 102. The cleaning member 142 is pressed against the photoconductor 102, and cleans the photoconductor 102 by scraping off, for example, any toner, external additive, or carrier, remaining on the surface of the photoconductor 102, or paper dust that adheres to the photoconductor 102.

The fixing device 480 includes a heating roller 482 that includes a heat source therein, and a pressure roller 484 that contacts the heating roller 482. At a contact portion between the heating roller 482 and the pressure roller 484, toner transferred to a sheet is heated and pressed to fix a toner image to the sheet.

The transfer device 200 includes the intermediate transfer body 210 as a transfer member that carries an image. The intermediate transfer body 210 is a belt-shaped body, and is, for example, endless. The intermediate transfer body 210 is supported by, for example, six support rollers 220, 222, 224, 226, 228, and 230 so as to be rotatable in the direction of arrow a in FIG. 1.

At least one of the six support rollers is used as a driving roller that transmits drive to the intermediate transfer body 210. In the exemplary embodiment, the support roller 230 is used as the driving roller. The support roller 230 is connected to, for example, a drive source 234 such as a motor. The support roller 226 is used as an opposing roller that opposes a second transfer roller 250 with the intermediate transfer body 210 interposed therebetween.

The transfer device 200 includes first transfer rollers 240K, 240Y, 240M, and 240C as first transfer members. The first transfer rollers 240K, 240Y, 240M, and 240C are each disposed on an inner side of the intermediate transfer body 210 so as to oppose a corresponding one of the four photoconductors 102 with the intermediate transfer body 210 interposed therebetween. A first transfer bias is applied to each of the first transfer rollers 240K, 240Y, 240M, and 240C, so that toner images of corresponding colors are transferred to the intermediate transfer body 210 from the four photoconductors 102 by the first transfer rollers 240K, 240Y, 240M, and 240C. The first transfer rollers 240K, 240Y, 240M, and 240C are sometimes collectively referred to as first transfer roller 240.

In the exemplary embodiment, the photoconductor 102 and the first transfer roller 240 are such that changes occur repeatedly between a state in which they are pressed against each other with the intermediate transfer body 210 interposed therebetween (may also be called "NIP") and a state in which they are separated from each other with the intermediate transfer body 210 interposed therebetween. The repeated changes may be realized by moving the photoconductor 102 or the image forming unit 100 including the photoconductor 102 towards the first transfer roller 240, or by moving the first transfer roller 240 towards the photoconductor 102. Here, the intermediate transfer body 210 may be moved along with the first transfer roller 240, or only the first transfer roller 240 may be separated without moving the intermediate transfer body 210. Here, with the photoconductor 102 and the first transfer roller 240 separated from each other, the photoconductor 102 and the first transfer roller 240 are not made to press against each other.

The transfer device 200 includes the second transfer roller 250. The second transfer roller 250 is used as a rotary body that contacts the intermediate transfer body 210 so as to form a transfer region N where a toner image is transferred to a sheet from the intermediate transfer body 210. A second transfer bias is applied to the second transfer roller 250, so that a toner image is transferred to the sheet from the intermediate transfer body 210 by the second transfer roller 250. The second transfer roller 250 is pressed against the intermediate transfer body 210 by a pressing mechanism or other mechanisms (not illustrated).

The sheet-feeding device 400 supplies a sheet towards the transfer region N. The sheet-feeding device 400 includes a sheet container 402 that contains stacked sheets, and a send-out roller 404 that sends out the sheets from the sheet container 402.

The transport path 500 is a transport path for transporting a sheet from the sheet-feeding device 400 towards the transfer region N and from the transfer region N towards the fixing device 480, and discharging the sheet from the inside of the image forming apparatus body 12. In the vicinity of the transport path 500, the send-out roller 404, transport rollers 510, registration rollers 520, the second transfer roller 250, and the fixing device 480 are disposed along the transport path 500 in that order from an upstream side in a sheet transport direction.

The registration rollers 520 temporarily stop the movement of a leading end portion of the sheet that is transported towards the transfer region N. Then, the registration rollers 520 cause the movement of the leading end portion of the sheet towards the transfer region N to be re-started in accordance with the timing at which a toner image is transported to the transfer region N by the intermediate transfer body 210.

Next, removal of the discharge products 700 adhered to the photoconductor 102 of the image forming apparatus 10 according to the exemplary embodiment is described principally with reference to FIGS. 3A to 6B.

Figure 3A:
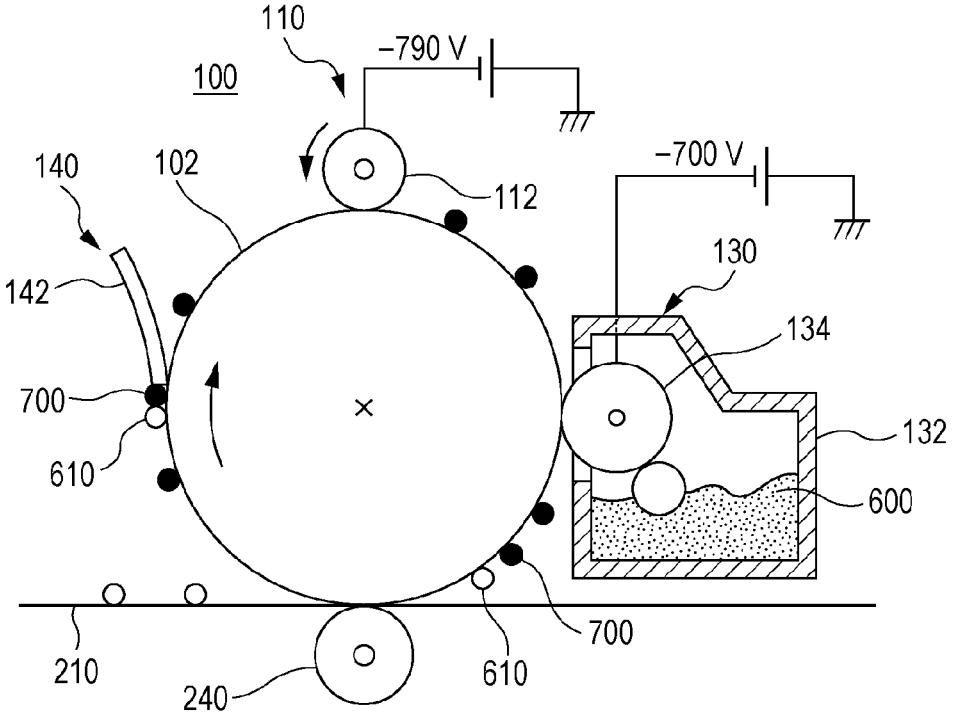
FIG. 3A corresponds to FIG. 2A and illustrates discharge products adhered to the photoconductor and external additives supplied to the photoconductor.

As illustrated in FIG. 3A, the discharge products 700, such as $NO_x$ or $SO_x$, generated by electric discharge at the charging device 110 are adhered to the photoconductor 102. If the discharge products 700 remain adhered to the photoconductor 102, defects may occur on an image that is developed during image formation. Therefore, the discharge products 700 are removed from the photoconductor 102.

In the exemplary embodiment, in order to remove the discharge products 700, during image non-formation where the image forming apparatus 10 does not form an image, the potential difference between the developing potential of the developing device 130 and the charging potential of the surface of the photoconductor 102 is made large and the number of external additives 610 that is supplied to the photoconductor 102 from the inside of the developing device 130 is increased, and the photoconductor 102 is separated from the first transfer roller 240 and the intermediate transfer body 210 to prevent a pressing force from being applied thereto. For the explanation, FIGS. 3A to 4B illustrate the external additives 610 that are supplied to the photoconductor 102. The details thereof are described below.

In the image forming apparatus 10 according to the exemplary embodiment, the discharge products 700 adhered to the surface of the photoconductor 102 are removed during the image non-formation where the image forming apparatus 10 does not form an image.

Figure 3B:
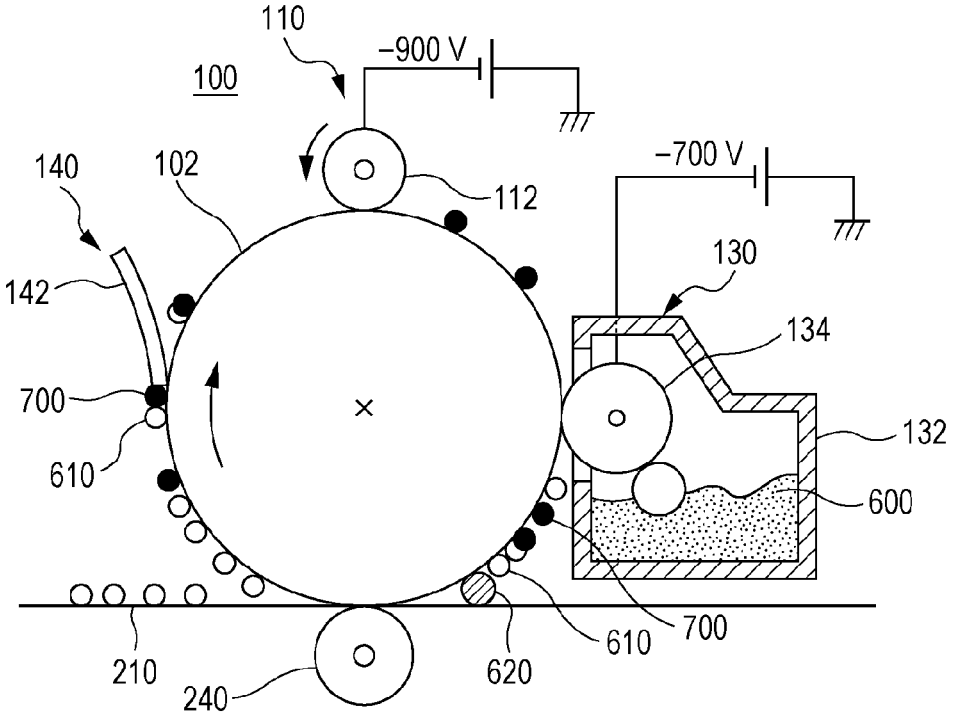
FIG. 3B illustrates a case in which the discharge products on the photoconductor are removed.

First, during the image non-formation in the image forming apparatus 10, when the discharge products 700 are to be removed, as illustrated in FIG. 3B, the potential difference between the developing potential of the developing device 130 and the charging potential of the surface of the photoconductor 102 is made large, and the number of external additives 610 that is supplied to the photoconductor 102 from the inside of the developing device 130 is increased.

Here, the photoconductor 102 is charged such that the voltage at which the photoconductor 102 is charged by the charging device 110 at this time differs from the developing voltage (−700 V) by a larger amount than when the charging voltage (−790 V) is generated during ordinary image formation. That is, in the exemplary embodiment, as illustrated in FIG. 3A, the charging voltage during the image formation is −790 V, so that the potential difference is −90 V, whereas when the discharge products 700 are to be removed, the photoconductor 102 is charged at a charging voltage of −900 V, so that the potential difference is −200 V.

Figure 5A:
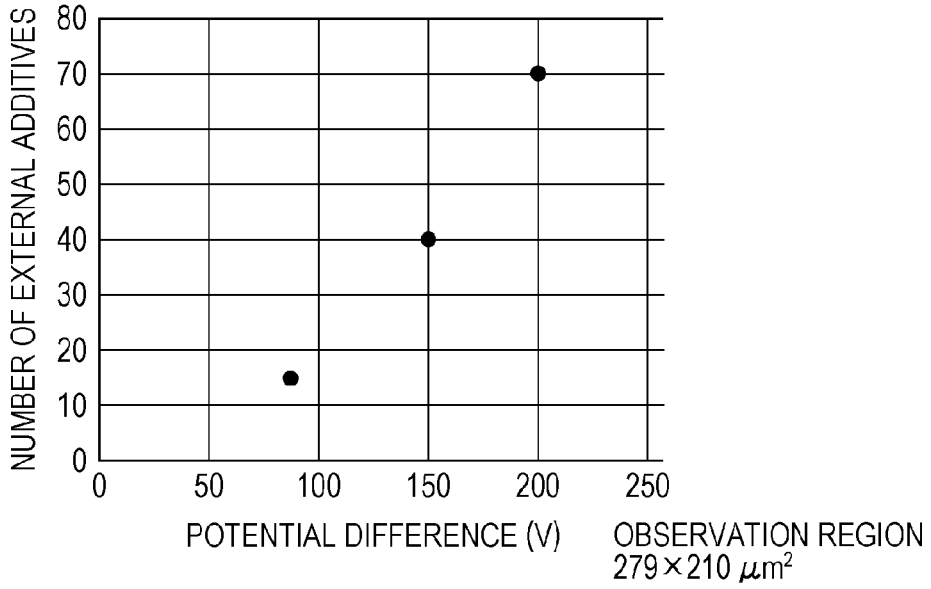
FIG. 5A is a graph showing the relationship between potential difference and the number of external additives that is supplied.

Here, FIG. 5A is a graph of the number of external additives supplied to the photoconductor depending upon the potential difference between the charging voltage and the developing voltage. The graph shows that the number of external additives 610 that is supplied increases as the potential difference between the charging voltage and the developing voltage increases. An observation region has a size of 279×210 $\mu m^2$.

Accordingly, by increasing the potential difference between the charging voltage and the developing voltage, it is possible to increase the number of external additives 610 that is supplied from the developing device 130 (described below).

Next, the developer 600 is supplied to the surface of the photoconductor 102 from the developing device 130. Here, since the potential difference between the charging voltage (−900 V) of the photoconductor 102 and the developing voltage (−700 V) is larger than that during the ordinary image formation, a larger number of external additives 610 is supplied to the photoconductor 102 (see FIG. 3B).

Figure 5B:
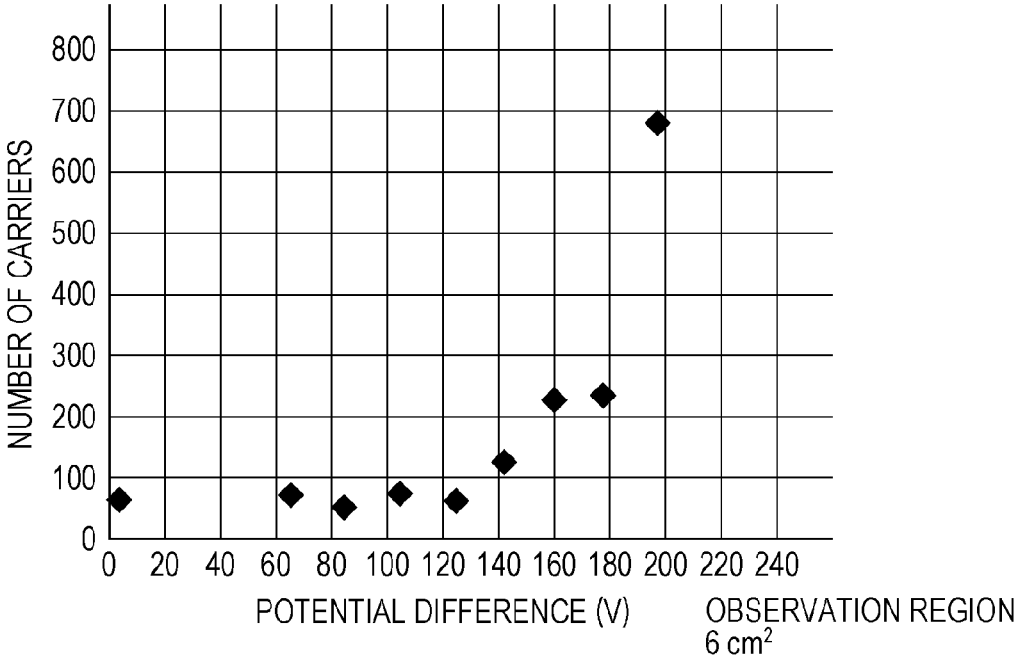
FIG. 5B is a graph showing the relationship between potential difference and the number of carriers that is supplied.

However, when the number of external additives 610 that is supplied is increased, the number of carriers 620 of the developer 600 that is supplied to the photoconductor 102 is increased. Here, FIG. 5B is a graph showing a comparison between the number of carriers that is supplied to the photoconductor depending on the potential difference between the charging voltage and the developing voltage. The graph shows that the number of carriers 620 that is supplied increases as the potential difference between the charging voltage and the developing voltage increases, and, in particular, shows that when the potential difference becomes −200 V as in the exemplary embodiment, the number of carriers 620 that is supplied increases suddenly. An observation region has a size of 6 $cm^2$.

The carriers 620 are made of, for example, metallic powder, such as iron powder, serving as a ferromagnetic material; and are harder and larger than the toner and the external additives 610. Therefore, the carriers 620 get caught between the photoconductor 102, the first transfer roller 240, and the intermediate transfer body 210; and, when pressed, defects, such as scratches, occur on the photoconductor 102 and improper transfer occurs.

Figure 4A:
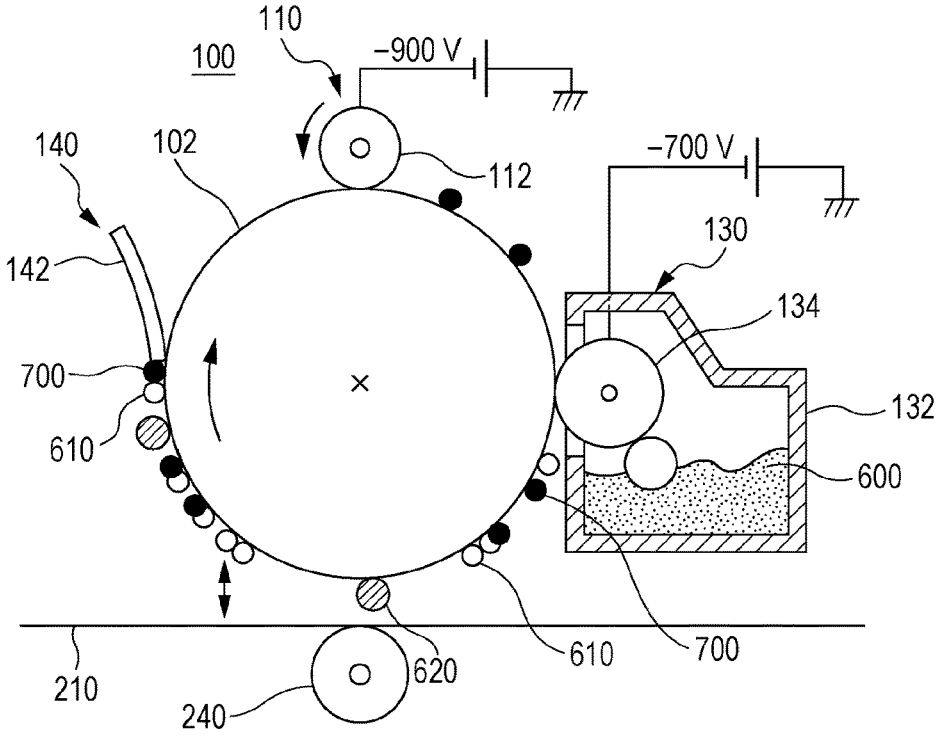
FIG. 4A illustrates a state in which the photoconductor and a first transfer roller are separated from each other.
Figure 4B:
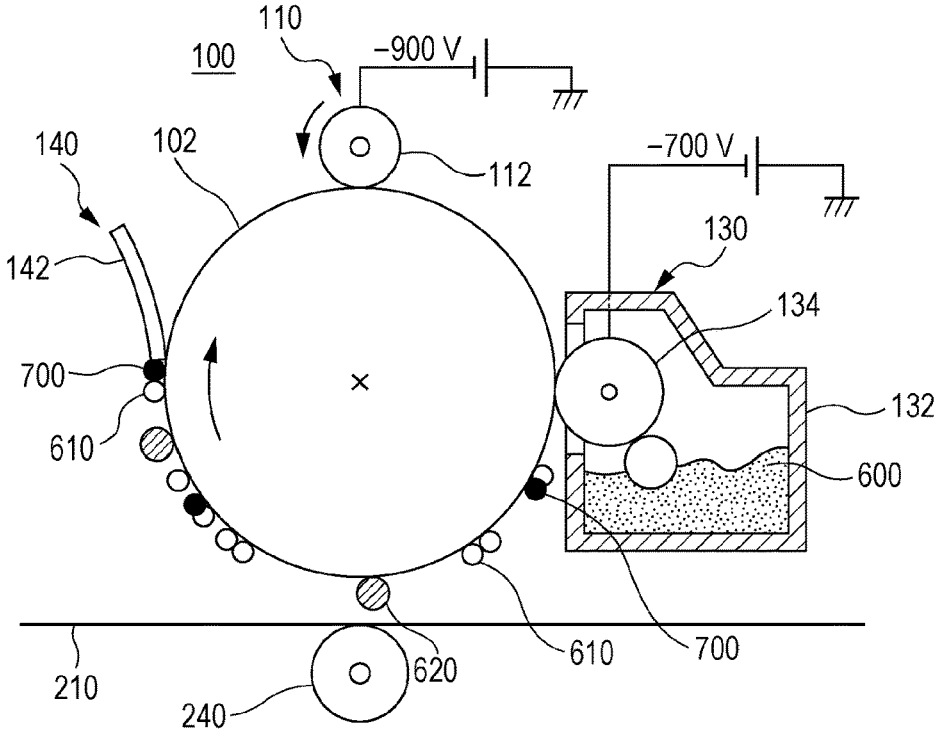
FIG. 4B illustrates a state in which the number of discharge products from a charging device is reduced.

Therefore, the image forming apparatus 10 according to the exemplary embodiment has a structure in which in removing the discharge products 700 during the image non-formation, the photoconductor 102 and the first transfer roller 240 are both separated from the intermediate transfer body 210 as illustrated in FIG. 4A.

Therefore, the carriers 620 that are supplied to the photoconductor 102 are no longer pressed at a location between the photoconductor 102, the first transfer roller 240, and the intermediate transfer body 210. Consequently, it is possible to prevent the occurrence of defects, such as scratches, on the photoconductor 102. By separating the photoconductor 102 and the first transfer roller 240, it is possible to prevent the external additives 610 supplied to the photoconductor 102 from moving onto the intermediate transfer body 210, and to remove a larger number of discharge products.

When the alternating-current (AC) component of the charging voltage of the charging device 110 is cut while removing the discharge products 700, it is possible to suppress the occurrence of discharge products during the removal of discharge products. Therefore, it is possible to remove a larger number of discharge products 700 (see FIG. 4B).

For example, the carriers 620 and the external additives 610 to which the discharge products 700 have adhered are collected by, for example, the cleaning device 140 by rotating the photoconductor 102.

Then, when the removal of the discharge products 700 is completed, the charging voltage of the charging device 110 is returned to the charging voltage of −790 V that is generated during the image formation, so that it is possible to perform the image formation (see FIG. 2A).

Evaluations regarding, the occurrence of defects on images when the difference between the charging voltage of the photoconductor 102 and the developing voltage of the toner to which the external additives 610 have been added is changed are shown in FIG. 6A. In the exemplary embodiment, the potential difference between the charging voltage of the photoconductor 102 and the developing voltage of the toner to which the external additives 610 have been added is −200 V; and, in comparative examples, the potential differences are −90 V and −150 V.

By using DocuCentre IV4-5570 (manufactured by Fuji Xerox Co., Ltd.), under high temperature and humidity (28 degrees/85% RH), 10000 striped chart image outputs are evaluated, and after waiting for 12 hours, halftone images (image density: 30%) are output, and white patches are evaluated as image defects in accordance with the following evaluation standards. When there are no white patches, the white-patch evaluation result is excellent; when there are virtually no white patches, the white-patch evaluation result is good; when white patches are capable of being seen, the white-patch evaluation result is fair; and when white patches are capable of being seen at first glance, the white-patch evaluation result is poor.

As a result, as shown in FIG. 6A, when the potential difference is −90 V or −150 V, which are less than −200 V, white patches may occur in the images and thus image defects may occur, whereas when the potential difference is −200 V, the occurrence of white patches may be suppressed. Therefore, as the potential difference between the developing voltage and the charging voltage of the photoconductor increases, the supply of external additives increases, so that it is possible to remove discharge products.

In the exemplary embodiment, when a case in which the AC component of the transfer device 200 is stopped and a case in which the AC component of the transfer device 200 is not stopped (is output) when removing the discharge products 700 are compared, as shown in FIG. 6A, it is possible to suppress the occurrence of white patches in images when the AC component is stopped than when the AC component is not stopped.

FIG. 6B shows evaluations of color points of images based on dents in the photoconductor 102 when the photoconductor 102 and the first transfer roller 240 are separated from each other and when they are not separated from each other (are in contact with each other). That is, when there are dents in the photoconductor, the photoconductor dent evaluation result is poor, whereas when there are no dents in the photoconductor, the photoconductor dent evaluation result is excellent. As a result, when the photoconductor 102 and the first transfer roller 240 are not separated from each other, color points appear in the images and dents occur in the photoconductor; whereas when the photoconductor 102 and the first transfer roller 240 are separated from each other, color points do not appear in the images, and dents do not occur in the photoconductor.

In the exemplary embodiment, the external additives 610 are described as being zinc stearate (ZnSt). However, other substances may be used as the external additives 610. Examples thereof include fatty acids such as barium stearate, lead stearate, iron stearate, nickel stearate, cobalt stearate, copper stearate, strontium stearate, calcium stearate, cadmium stearate, magnesium stearate, zinc oleate, manganese oleate, iron oleate, cobalt oleate, lead oleate, magnesium oleate, copper oleate, zinc palmitate, cobalt palmitate, copper palmitate, magnesium palmitate, aluminum palmitate, calcium palmitate, lead caprylate, lead caproate, zinc linolenate, cobalt linolenate, calcium linolenate, and cadmium linolenate.

Although the protective layer 108 of the photoconductor 102 according to the exemplary embodiment is described as being a layer that contains at least gallium (Ga) and oxygen (O) as constituent elements, it is desirable that the protective layer be a non-monocrystalline film, such as an amorphous film, a polycrystalline film, or a microcrystalline film, containing oxygen (O) and gallium (Ga) as constituent elements. Further, the protective layer may contain hydrogen and at least one type of halogen element, in addition to oxygen (O) and gallium (Ga). Further, the protective layer may be, for example, a layer that contains magnesium fluoride as a principal component, a layer that is made of amorphous silicon carbide, a layer that contains gallium in amorphous carbon, a layer that contains amorphous carbon nitride including a diamond bond, a layer that contains a non-monocrystalline hydrogenated/nitride semiconductor, a layer that contains oxygen and a Group 13 element and whose oxygen content in an outermost surface is greater than 15 atom %, or a layer that contains oxygen and a Group 13 element in an element composition ratio (oxygen/Group 13 element) of 1.1 to 1.5.

Although, in the exemplary embodiment, the intermediate transfer body is described as a transfer member, a structure in which development is directly performed with respect to a recording medium serving as a transfer material may be used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a rotatable image carrier that carries an image;

a charging unit that includes a rotatable charging member that charges the image carrier;

a developing unit that supplies developer to the image carrier that is charged, the developer containing at least toner and a carrier, an external additive being added to the toner;

a transfer unit that includes a transfer member that transfers the image formed on the image carrier to a transfer material; and a cleaning unit that cleans a surface of the image carrier, wherein, during image non-formation, the external additive is supplied to the image carrier that rotates, and the image carrier and at least the transfer member are separated from each other, wherein a potential difference between a charging voltage at which the charging unit charges the image carrier and a developing voltage at which the developing unit charges the toner is larger during the image non-formation than during image formation.

2. The image forming apparatus according to claim 1, wherein the external additive has a property of adhering to a discharge product.

3. The image forming apparatus according to claim 1, wherein the external additive is zinc stearate.

4. The image forming apparatus according to claim 1, wherein the image carrier includes at least a protective layer on a surface-side thereof, and wherein the protective layer is a layer containing at least gallium and oxygen as constituent elements.

5. An image forming apparatus comprising:

a rotatable image carrier that carries an image;

a charging unit that includes a rotatable charging member that charges the image carrier;

a developing unit that supplies developer to the image carrier that is charged, the developer containing at least toner and a carrier, an external additive being added to the toner;

a transfer unit that includes a transfer member that transfers the image formed on the image carrier to a transfer material; and a cleaning unit that cleans a surface of the image carrier, wherein, during image non-formation, the external additive is supplied to the image carrier that rotates, and the image carrier and at least the transfer member are separated from each other, wherein the number of external additives that is supplied from the developing unit to the image carrier is larger during the image non-formation than during image formation.

6. An image forming apparatus comprising:

a rotatable image carrier that carries an image;

a charging unit that includes a rotatable charging member that charges the image carrier;

a developing unit that supplies developer to the image carrier that is charged, the developer containing at least toner and a carrier, an external additive being added to the toner;

a transfer unit that includes a transfer member that transfers the image formed on the image carrier to a transfer material; and a cleaning unit that cleans a surface of the image carrier, wherein, during image non-formation, the external additive is supplied to the image carrier that rotates, and the image carrier and at least the transfer member are separated from each other, wherein when the charging unit charges the image carrier, at least an alternating current component that is superimposed upon a charging voltage is stopped.

* * * * *